US008468993B2

(12) United States Patent
Sheridan et al.

(10) Patent No.: US 8,468,993 B2
(45) Date of Patent: Jun. 25, 2013

(54) MANIFOLD COMMUNICATION CHANNEL

(75) Inventors: Brian Michael Hynes Sheridan, West Bend, WI (US); Joel A. Propson, Chilton, WI (US); William Harvey Atkinson, New Holstein, WI (US)

(73) Assignee: Kohler Co., Kohler, WI (US)

( * ) Notice: Subject to any disclaimer, the term of this patent is extended or adjusted under 35 U.S.C. 154(b) by 455 days.

(21) Appl. No.: 12/169,471

(22) Filed: Jul. 8, 2008

(65) Prior Publication Data

US 2009/0013955 A1 Jan. 15, 2009

Related U.S. Application Data

(60) Provisional application No. 60/949,372, filed on Jul. 12, 2007.

(51) Int. Cl.
*F02M 35/10* (2006.01)

(52) U.S. Cl.
USPC ..... 123/184.36; 123/184.21; 123/184.32

(58) Field of Classification Search
USPC ..... 123/583, 584, 184.32, 547, 59.5, 123/597, 184.33, 581, 582, 342, 337, 73 A, 123/184.21–184.37, 184.59; 261/23.2, 65, 261/23.1, 23.8, 41.1, 41.3
See application file for complete search history.

(56) References Cited

U.S. PATENT DOCUMENTS

| | | | | | |
|---|---|---|---|---|---|
| 2,730,339 | A | | 1/1956 | Presnell | |
| 2,871,843 | A | | 2/1959 | Hamilton | |
| 2,966,150 | A | * | 12/1960 | Wiltshire et al. | 123/184.46 |
| 4,264,535 | A | * | 4/1981 | Kikura | 261/23.2 |
| 4,331,113 | A | * | 5/1982 | Tadokoro et al. | 123/198 F |
| 4,520,775 | A | * | 6/1985 | Nakamura | 123/308 |
| 4,553,507 | A | * | 11/1985 | Shaffer | 123/184.34 |
| 5,005,533 | A | * | 4/1991 | Suzuki et al. | 123/184.22 |
| 5,537,965 | A | | 7/1996 | Topfer et al. | |
| 5,809,972 | A | * | 9/1998 | Grant | 123/478 |
| 5,823,156 | A | * | 10/1998 | Thiel et al. | 123/184.31 |
| 6,481,698 | B1 | * | 11/2002 | Calvin et al. | 261/23.2 |
| 6,520,146 | B2 | * | 2/2003 | Laimbock | 123/308 |
| 6,742,771 | B2 | | 6/2004 | Bayer et al. | |
| 6,805,087 | B2 | | 10/2004 | Yakabe et al. | |
| 7,089,921 | B2 | | 8/2006 | Matsuoka et al. | |
| 7,201,129 | B2 | | 4/2007 | Ohba et al. | |
| 7,591,257 | B2 | | 9/2009 | Bayer et al. | |
| 7,905,469 | B2 | * | 3/2011 | Nickels et al. | 261/16 |
| 2004/0155366 | A1 | | 8/2004 | Laneuville | |
| 2005/0061266 | A1 | | 3/2005 | Kapala et al. | |
| 2006/0231081 | A1 | | 10/2006 | Kirakosyan | |

OTHER PUBLICATIONS

PCT International Preliminary Report on Patentability, Relating to International Application No. PCT/US2008/003497, Date of Issuance Jan. 12, 2010 (13 Pgs.).

* cited by examiner

*Primary Examiner* — Lindsay Low
*Assistant Examiner* — Tea Holbrook
(74) *Attorney, Agent, or Firm* — Whyte Hirschboeck Dudek S.C.

(57) ABSTRACT

A manifold, such as an intake manifold or a fuel injection manifold, for use in an internal combustion engine, as well as a method of operating such an engine, are disclosed. In at least one embodiment, the manifold includes an input end capable of being coupled at least indirectly to an air input device, first and second intake tubes linking the input end to first and second exit ports, respectively, and a first communication channel linking the first and second intake tubes. The communication channel has a first width that is substantially less than a second width of at least one of the first and second intake tubes, and the communication channel links upper portions of the first and second intake tubes, while lower portions of the intake tubes remain separated by a wall.

21 Claims, 9 Drawing Sheets

MANIFOLD COMMUNICATION CHANNEL

CROSS-REFERENCE TO RELATED APPLICATIONS

This application claims the benefit of U.S. provisional patent application No. 60/949,372 filed on Jul. 12, 2007 and entitled "Manifold Communication Channel", which is hereby incorporated by reference herein.

STATEMENT REGARDING FEDERALLY SPONSORED RESEARCH OR DEVELOPMENT

Not applicable

FIELD OF THE INVENTION

The present invention relates to internal combustion engines and, more particularly, relates to air intake components such as intake manifolds that are employed in internal combustion engines.

BACKGROUND OF THE INVENTION

Internal combustion engines are used in a wide variety of applications including, for example, automobiles, boats, aircraft, lawnmowers, tractors, snow blowers, and power machinery. Many such internal combustion engines employ a carburetor to provide an appropriate fuel/air mixture (often referred to as "charge") to the combustion chamber(s) of a cylinder block. Further, in many such engines that employ two or more cylinders, an intake manifold is employed that links the carburetor to the multiple cylinders. In some such engines, the carburetors have two or more barrels by which charge is generated for different respective engine cylinders that are coupled to the respective barrels by way of dedicated channels within the intake manifolds linking the cylinders with the carburetors.

In many applications involving internal combustion engines, high output power levels from the engines are desirable. Yet the maximum amount of power that can be output by a given internal combustion engine having a carburetor is limited by the size or displacement of the engine, as well as the size of the carburetor venturi and the rated RPM. In the case of multi-cylinder internal combustion engines in which the cylinders are respectively coupled to respective barrels of multi-barrel carburetors, one known manner of enhancing the output power of such an engine is by providing a communication channel or bridge that links multiple barrels of the carburetor and/or corresponding intake tubes within the intake manifold. Such a communication channel can allow charge to flow between the different barrels/intake tubes/cylinders of the engine, and as a result can allow (at least some of the time) a given engine cylinder to receive charge from both barrels, thus increasing power from that cylinder.

Although such communication channels can allow multi-cylinder engines to achieve higher power levels, such conventional channels do not always produce consistent or desirable output power results. Further, conventional communication channels, while tending to enhance engine output power, also tend to alter the fuel/air mixture provided to the engine cylinders and increase engine emissions. This is undesirable, since reduced emission levels from internal combustion engines are increasingly desired. Indeed, several regulations have recently been enacted, and/or potentially will be enacted in the near future, requiring engines to meet more stringent emissions standards.

For at least these reasons, therefore, it would be advantageous if an improved mechanism for achieving higher output power levels from a multi-cylinder internal combustion engine with a multi-barrel carburetor could be developed. In at least some embodiments, it would be desirable if such an improved mechanism not only enhanced output power levels of the engine but also did so in a manner that did not greatly increase engine emissions.

SUMMARY OF THE INVENTION

The present inventors have recognized that the conventional manner of implementing communication channels to link the multiple barrels of multi-barrel carburetors in multi-cylinder engines results in increased engine emissions at least in part because the output of charge by carburetors tends to be accompanied by the output of amounts of unevaporated fuel or "wet fuel", because such wet fuel is able to proceed in excessive amounts to a given engine cylinder when a communication channel linking multiple carburetor barrels is present, and because these amounts of wet fuel often are not adequately consumed during combustion. The inventors also have recognized that, while the presence of such wet fuel cannot be entirely eliminated when using conventional carburetors, such wet fuel typically is concentrated physically near the bottoms of the barrels of a carburetor and proceeds generally nearer the bottoms of the intake tubes of an intake manifold proximate where the intake manifold is coupled to the carburetor.

The present inventors additionally have recognized that, given this predominant location of wet fuel (at least proximate the junction between the carburetor and intake manifold coupled thereto), engine emissions would tend not to increase as much due to the presence of a communication channel or bridge linking the multiple carburetor barrels or multiple intake tubes of the intake manifold coupled to those barrels if the communication channel served to link the physically higher/upper portions of those intake tubes/barrels but not the physically lower portions of those intake tubes/barrels.

More particularly, given the location of a communication channel in this manner, charge can still proceed between the different barrels/intake tubes, and thus charge from multiple carburetor barrels can still proceed to a given cylinder. At the same time, because the communication channel does not link the lower portions of the barrels/intake tubes, wet fuel arising from a given carburetor barrel is largely or entirely precluded from proceeding to a cylinder associated with a different carburetor barrel, and consequently excessive amounts of wet fuel from multiple cylinder barrels are largely if not entirely prevented from proceeding to any single cylinder where the wet fuel might not properly be consumed. Further, while such a communication channel can be limited in terms of its width, and in particular have a width less than the width of the barrels or intake tubes that it is connecting, by extending the depth of the communication channel along the intake tubes (e.g., in the direction of flow through those tubes), it is still possible for significant amounts of charge to pass between neighboring intake tubes, and thus possible for significant engine power enhancements to be achieved.

In at least some embodiments, the present invention relates a manifold for use in conjunction with an internal combustion engine. The manifold includes an input end capable of being coupled at least indirectly to an air input device, first and second intake tubes linking the input end to first and second exit ports, respectively, and a first communication channel linking the first and second intake tubes. The communication channel has a first width that is substantially less than a second width of at least one of the first and second intake tubes, and the communication channel links upper portions of the first and second intake tubes, while lower portions of the intake tubes remain separated by a wall. In at least some such embodiments, the manifold is an intake manifold for use with a carburetor, while in at least some other such embodiments, the manifold is a fuel injection manifold.

Additionally, in at least some embodiments, the present invention relates to an air intake assembly. The assembly includes a multi-barrel carburetor, and an intake manifold coupled at least indirectly to the carburetor downstream of the carburetor, the intake manifold having multiple passages respectively coupled at least indirectly to respective barrels of the multi-barrel carburetor. The intake manifold further includes means for linking at least two of the multiple passages in a manner consistent with allowing charge to pass between the multiple passages but limiting passage of wet fuel between the multiple passages.

Further, in at least some embodiments, the present invention relates to a method of operating an internal combustion engine. The method includes providing an air intake assembly including a multi-barrel carburetor coupled at least indirectly to a multi-channel intake manifold, operating the multi-barrel carburetor to generate first and second amounts of charge and first and second portions of wet fuel, and communicating the first and second amounts of the charge respectively and the first and second portions of the wet fuel respectively to respective input ends of respective first and second channels of the multi-channel intake manifold. The method additionally includes passing at least some of the first amount of charge from the first channel into the second channel by way of a communication bridge while also restricting passage of at least some of the first portion of the wet fuel from the first channel into the second channel.

DETAILED DESCRIPTION OF THE PREFERRED EMBODIMENT

Figure 1A:
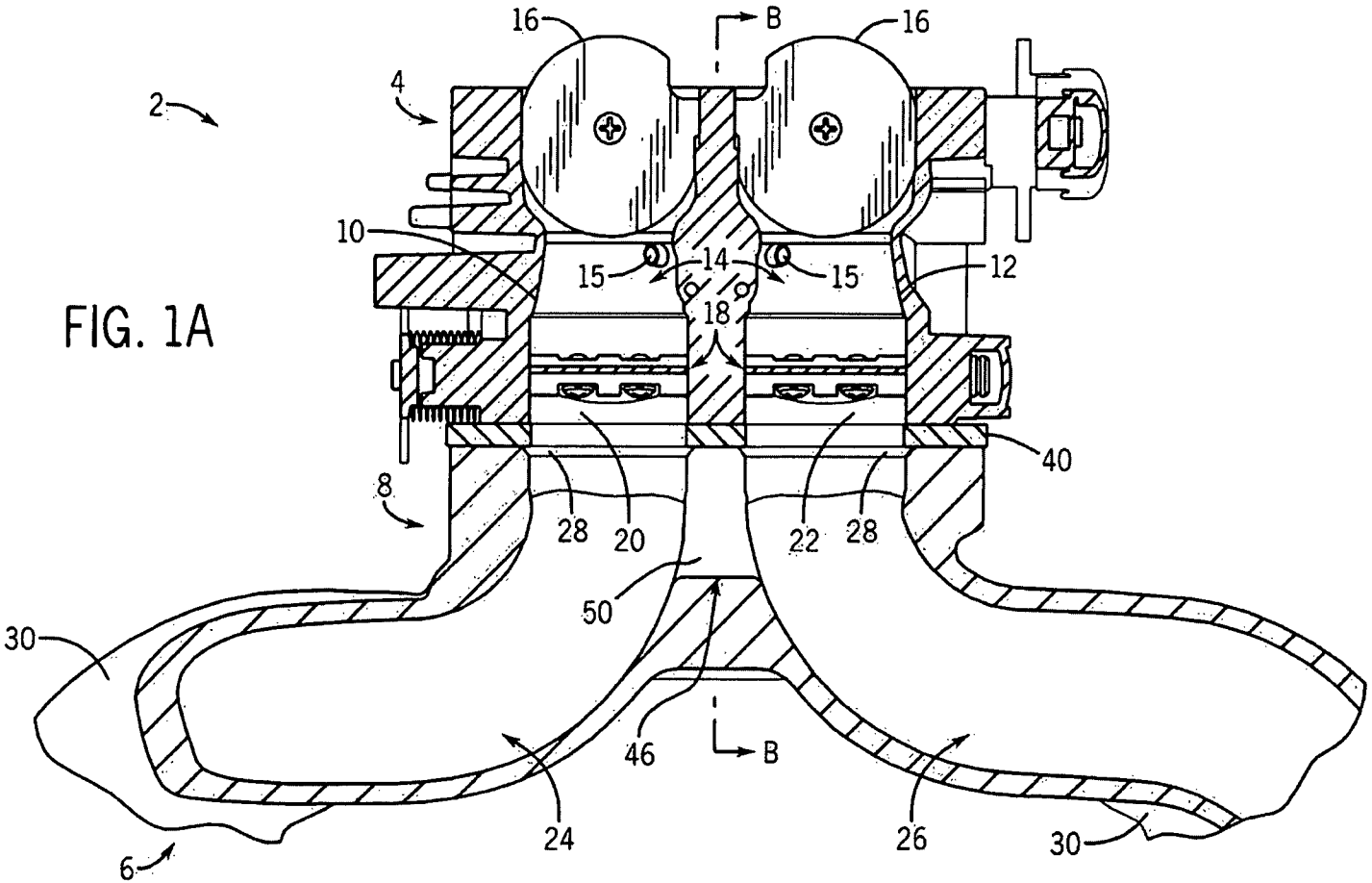
FIG. 1A is a top cross-sectional view of a cutaway portion of an assembly of a two-barrel carburetor and an intake manifold of a horizontal crankshaft engine in accordance with one exemplary embodiment of the present invention.
Figure 1B:
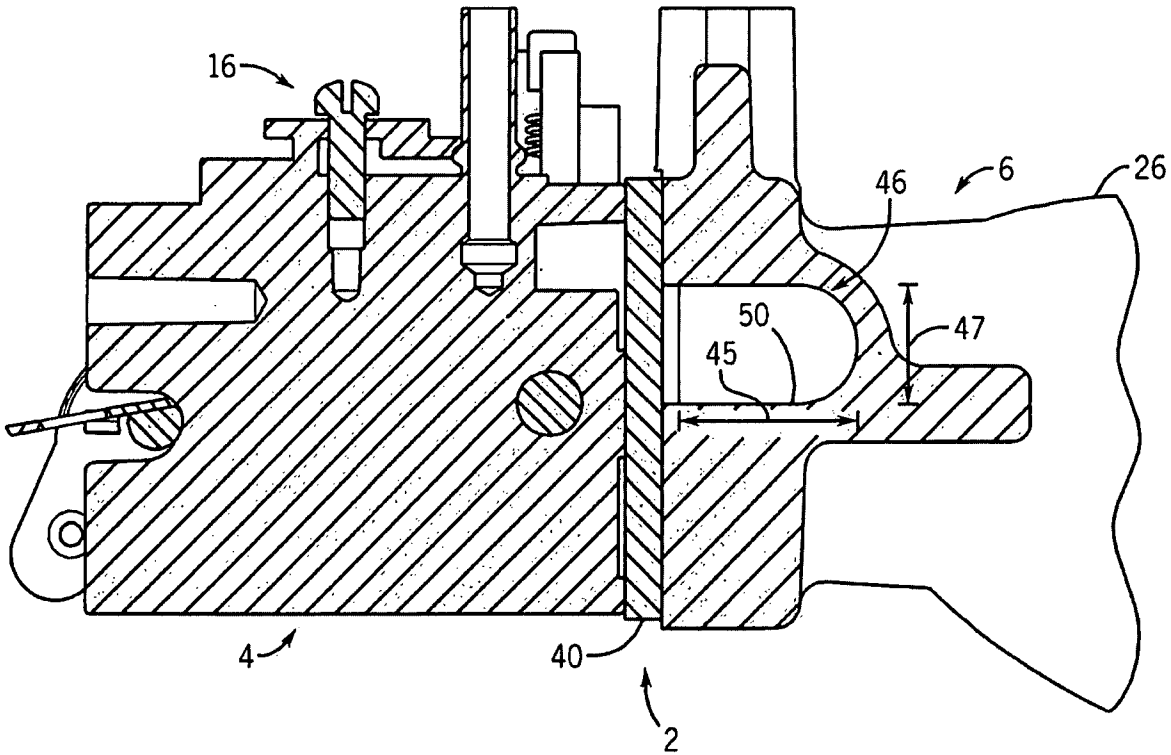
FIG. 1B is an additional, side cross-sectional view of the assembly of FIG. 1A, taken perpendicularly to the view of FIG. 1A, along a mid-line of the assembly extending between the two barrels of the carburetor (specifically along line B-B of FIG. 1A)

Referring to FIGS. 1A and 1B, first and second cross-sectional views are provided, in cutaway, of portions of an air intake assembly 2 of a horizontal crankshaft internal combustion engine, in accordance with a first embodiment of the present invention. The cross-sectional view of FIG. 1A in particular is a top cross-sectional view, that is, a view that would be obtained if one looked downward at a cross-section of the air intake assembly 2 (as oriented for normal operational circumstances) when an upper portion of that assembly was removed. As for the cross-sectional view of FIG. 1B, that view in particular is a side cross-sectional view of the air intake assembly 2 taken along a line B-B of FIG. 1A. As shown, the air intake assembly 2 in the present embodiment includes a carburetor 4 and an intake manifold 6, which includes a communication port 8 configured for interfacing an output port of the carburetor.

With respect to the carburetor 4 in particular, it is a two-barrel carburetor having barrels 10 and 12 (see FIG. 1A). Each of the barrels 10, 12 includes a respective venturi region 14 for mixing air and fuel together to produce an air/fuel mixture, also known as charge. Fuel in particular is drawn into the respective venturi regions 14 from respective fuel input channels 15 located proximate the bottoms of the respective barrels 10, 12, due to pressure differentials arising from venturi action within those venturi regions as air passes through those regions. Additionally, each of the barrels 10, 12 includes a respective choke 16 for proving a richer air/fuel mixture during cold start-up of the engine, and a respective throttle valve 18 located downstream of the respective venturi portion 14, by which airflow (e.g., charge flow) through each barrel can be governed. Downstream of the respective throttle valves 18 are respective output orifices 20, 22 that form the output port of the carburetor 4 and that are configured to interface the communication port 8 of the intake manifold 6. By virtue of the barrels 10, 12 having their own respective venturi regions 14, throttle valves 18 and output orifices 20, 22, each barrel is capable of independent operation in terms of producing charge within its respective venturi region and providing it to the intake manifold 6.

Figure 4:
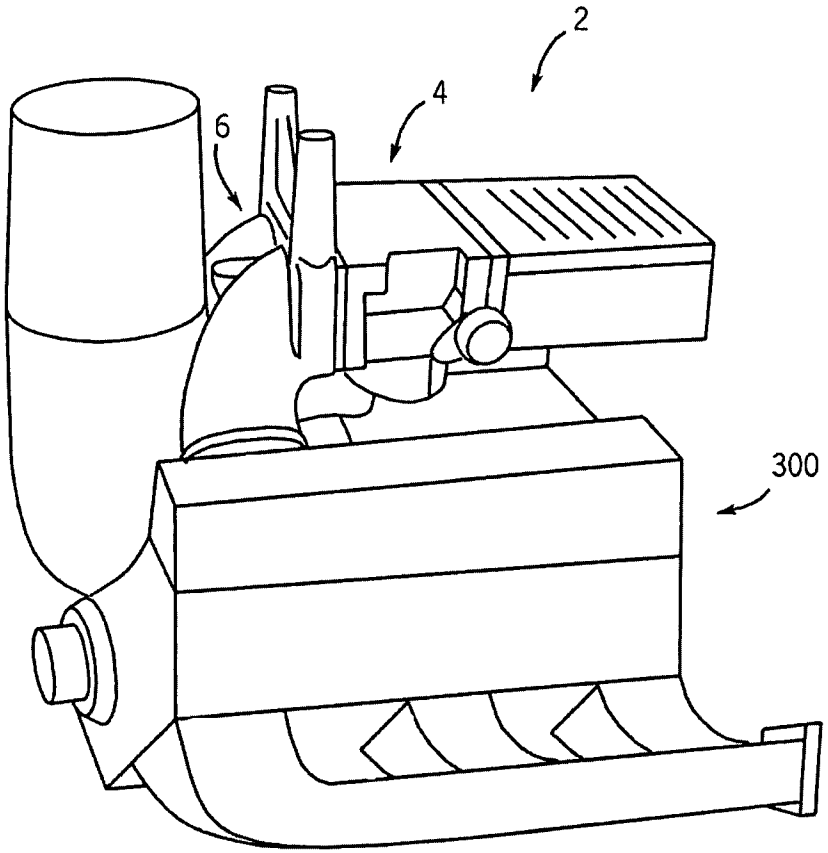
FIG. 4 is a perspective side view of an exemplary engine on which a carburetor and an intake manifold are mounted.

As for the intake manifold 6, it is designed to receive charge from the carburetor 4 and communicate that charge to cylinders of an engine (e.g., an engine 300 as shown in FIG. 4) that are coupled to the intake manifold downstream of the communication port 8. In the present embodiment, the intake manifold 6 in particular is configured to communicate charge from the first and second barrels 10, 12 of the carburetor 4, as received via the respective orifices 20, 22, to first and second engine cylinders (not shown) by way of first and second intake tubes 24 and 26, respectively. To effectively communicate charge from the carburetor barrels 10, 12, each of the intake tubes 24 and 26 is a cylindrical tube of substantially uniform cross-sectional area along its length, with smooth cylindrical sidewalls and open inlet and outlet ends 28 and 30 respectively. In particular, the respective inlet ends 28 of the respective intake tubes 24 and 26 form part of the communication port 8, and are respectively positioned adjacent the respective output orifices 20 and 22 of the carburetor 4 for receiving charge from the barrels 10 and 12, respectively.

Figure 1C:
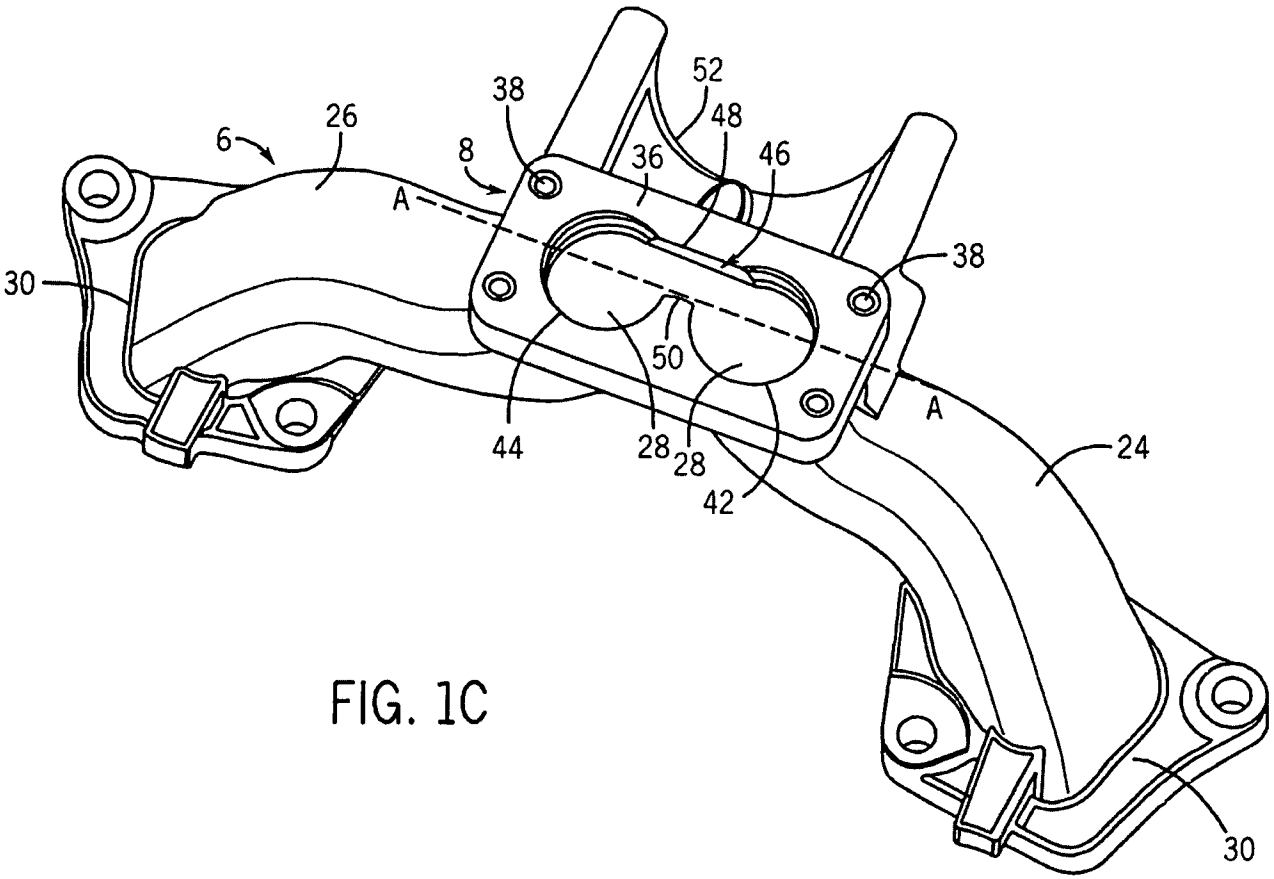
FIG. 1C is a front perspective view of the intake manifold of FIG. 1A, particularly showing a communication port of the intake manifold that is capable of being coupled to the carburetor.

Referring additionally to FIG. 1C, a top, perspective view of the entire intake manifold 6 shows the respective intake tubes 24 and 26 as having substantially cylindrical sidewalls 42 and 44, respectively, and also as proceeding from the inlet ends 28 at the communication port 8 in substantially opposite directions from one another toward the outlet ends 30. More particularly, each of the intake tubes 24, 26 is curved in a generally S-shaped manner as one proceeds from its respective inlet end 28 to its respective outlet end 30, such that the intake tubes curve away from one another as one proceeds from their inlet ends (which are adjacent one another) to their outlet ends (which are spaced apart). Also, given the general S-shape of the intake tubes 24, 26, the direction of charge inflow into the inlet ends 28 is in substantially the same direction as the direction of charge outflow from the outlet ends 30. Further as shown, the communication port 8 of the intake manifold 6 with its inlet ends 28 is formed within a support flange 36. In the present embodiment, the support flange 36 includes four holes 38 by which the carburetor 4 can be attached to the intake manifold 6 by way of screws, bolts or other fastening mechanism(s) (not shown). Also in the present embodiment, the top surface of the support flange 36 has extending therefrom a support 52, to which an air cleaner can be attached. In at least some embodiments, the intake manifold 6 with its two intake tubes 24, 26 is manufactured as a single molded piece or, alternatively, as multiple parts that are then connected/fastened together.

FIG. 1C also shows a midline A-A extending along the support flange 36 of the intake manifold 6 and in particular passing through the centers of each of the inlet ends 28. It will be noted that, if a cross-sectional view were taken along the midline A-A shown in FIG. 1C, that view would be the cross-sectional view of the intake manifold 6 shown in FIG. 1A. Further, notwithstanding the above indications that the carburetor 4 directly interfaces the flange 36/communication port 8, it should be noted that, in the present embodiment, a gasket 40 (specifically shown in FIG. 1A) is provided at the downstream end of the carburetor, and it is this gasket that actually interfaces the flange/communication port of the intake manifold 6. The gasket 40, which can be considered to form a part of the carburetor 4, nevertheless is distinct from the remainder of the carburetor and is held in place by the screws or other fastening mechanism(s) by which the intake manifold 6 and carburetor 4 are attached. The gasket 40 can be made from a variety of materials including, for example, rubber or plastic, and serves both to seal the junction between the support flange 36 and the remainder of the carburetor 4 as well as to provide thermal insulation therebetween.

Additionally as shown in FIGS. 1A-1C, in the present embodiment the intake manifold 6 is configured to include a communication channel or bridge 46 that links the intake tubes 24, 26. In the present embodiment, the communication channel 46 is positioned proximate the edge of the flange 36/communication port 8 that interfaces the carburetor 4/gasket 40 such that, when the intake manifold 6 is coupled to the carburetor 4, the communication channel extends from the gasket 40 inward into the intake manifold. Also, as shown best in FIG. 1C, the communication channel 46 particularly is formed above the midline A-A. That is, below the midline A-A, a wall 50 of the intake manifold 6 remains in place that separates the two intake tubes 24 and 26 from one another. Due to the cylindrical shape of the tubes 24, 26, the communication channel 46 is rather short in length proximate the wall 50 while, farther (e.g., upward) from that wall the communication channel has a lengthier surface 48. Further, particularly as shown in FIG. 1B, the communication channel 46 in the present embodiment is U-shaped and has a depth 45 inward into the intake manifold 6 that is greater a width 47, as measured within the plane of the communication port 8 (or a plane substantially parallel thereto as shown).

The above-described intake manifold 6 having the communication channel 46 allows for enhanced engine performance in several regards. To begin, because the two intake tubes 24, 26 are linked, in effect the two carburetor barrels 10, 12 are also linked. Consequently, while charge from each of the barrels 10, 12 that exits the carburetor 4 enters its respective intake tube 24, 26, the charge is also able to move between the two intake tubes such that the charge from the first barrel 10 can potentially enter and proceed down the intake tube 26 and the charge from the second barrel 12 can potentially enter and proceed down the intake tube 24. Movement of charge in this manner between the different intake tubes 24, 26 is particularly enhanced due to the relatively large depth 45 of the channel 46, which allows for significant cross-coupling of charge notwithstanding the limited width 47 of the channel.

Such cross-supplying of charge between the different barrels/intake tubes is beneficial to engine operation insofar as, depending upon the engine's operational status, lesser or greater amounts of charge can be delivered to a given cylinder to better suit its needs at that time. More particularly, when higher power is demanded from the engine (e.g., the engine is operated at "full-throttle"), more power can be generated by a given cylinder than would otherwise be possible since, instead of receiving charge from only a single one of the two barrels 10, 12, the cylinder can also obtain charge from the other of the two barrels. Additionally, it should further be noted that, due to the particular shape of the communication channel 46, the likelihood of back flow during cam overlap is reduce, and idle running quality is also improved because the vacuum signal in each port is balanced.

In addition to allowing for more engine power, the particular configuration of the communication channel 46 also substantially or entirely prevents any concomitant increased levels of engine emissions that might otherwise occur as a result of linking the two intake tubes 24, 26 and communicating additional amounts of wet fuel therebetween. Given the embodiment of FIGS. 1A-1C, during normal operational circumstances the wall 50 separates the two intake tubes 24, 26 nearer the bottom of the intake manifold 6 (e.g., below the midline A-A), and flow between the intake tubes by way of the channel 46 is restricted to the region nearer the top of the intake manifold (e.g., above the midline A-A). Because of gravity, and/or because of the orientation of the carburetor 4 and particularly its fuel input channels 15 (which are located proximate the bottom surfaces of the carburetor barrels 10, 12), wet fuel is concentrated near the bottom portions of the carburetor barrels 10, 12 as it leaves the carburetor and enters the communication port 8, rather than evenly distributed from top to bottom. Consequently, the wall 50 serves as an obstruction to the passage of condensed and un-vaporized wet fuel between the intake tubes 24, 26 even though the communication channel 46 allows for the passage of more perfectly gaseous, atomized charge between those tubes.

Figure 2A:
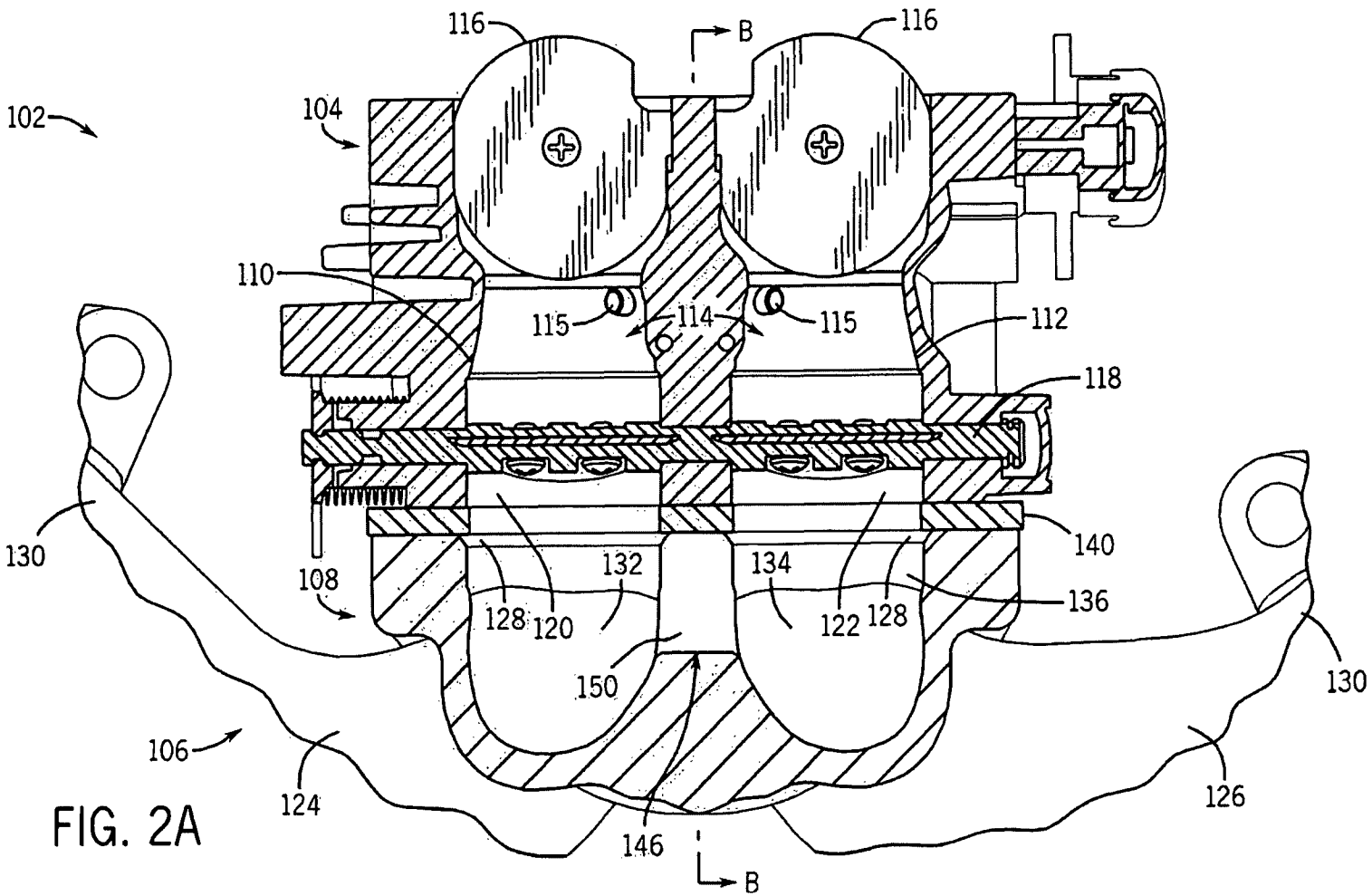
FIG. 2A is a top cross-sectional view of a cutaway portion of an assembly of a two-barrel carburetor and an intake manifold of a vertical crankshaft engine in accordance with another exemplary embodiment of the present invention.
Figure 2B:
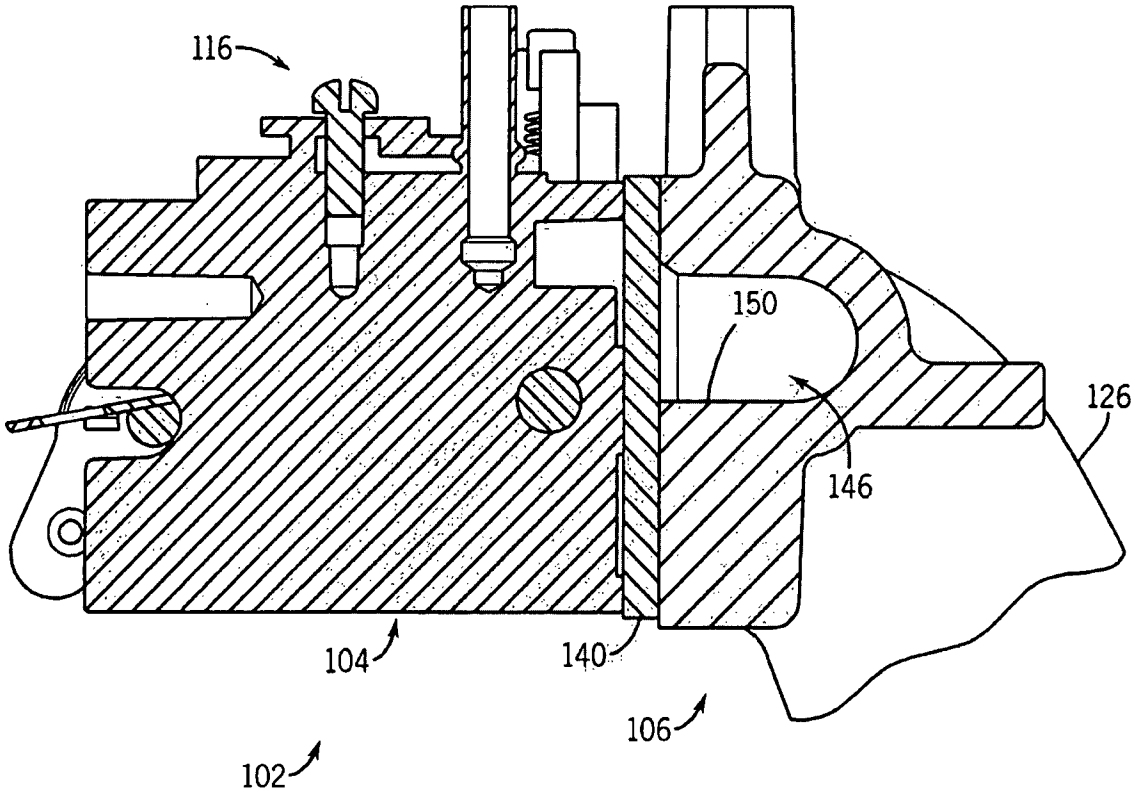
FIG. 2B is an additional, side cross-sectional view of the assembly of FIG. 2A, taken perpendicularly to the view of FIG. 2A, along a mid-line of the assembly extending between the two barrels of the carburetor (specifically along line B-B if FIG. 2A)
Figure 2C:
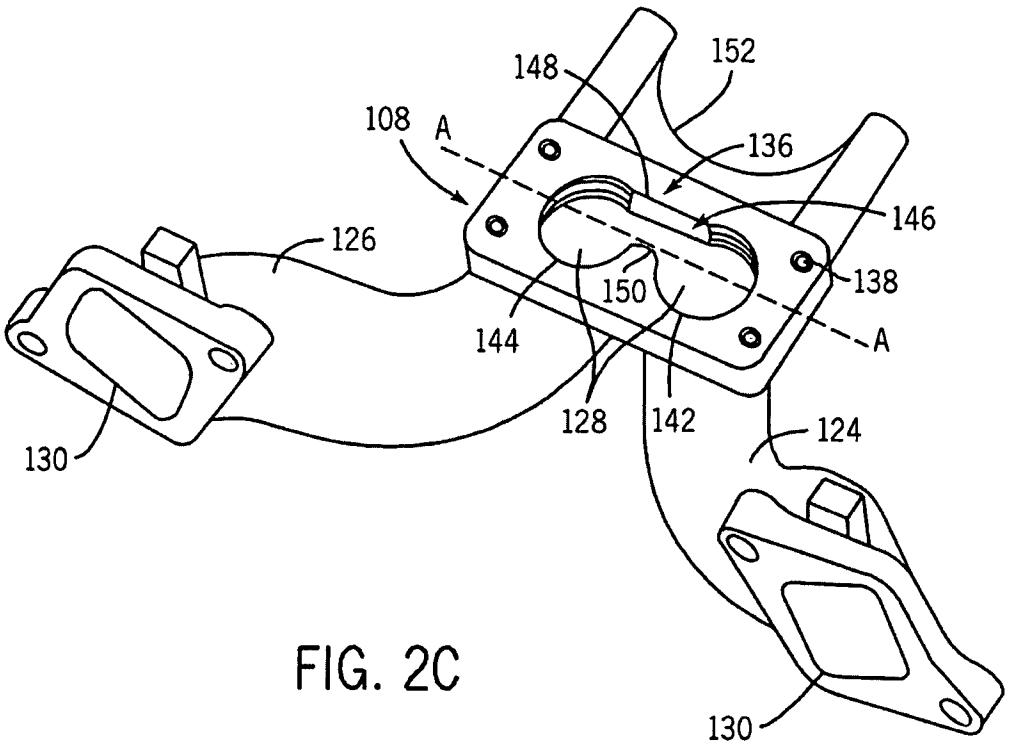
FIG. 2C is a front perspective view of the intake manifold of FIG. 2A, particularly showing a communication port of the intake manifold that is capable of being coupled to the carburetor.

Notwithstanding the above description relating to the embodiment of FIGS. 1A-1C, the present invention is intended to encompass numerous other embodiments as well. For example, while FIGS. 1A-1C show an embodiment suitable for use with a horizontal crankshaft engine, FIGS. 2A-2C show another embodiment of an air intake assembly 102 including a carburetor 104 and an intake manifold 106 that is suitable for use with a vertical crankshaft engine. In particular, similar to FIGS. 1A and 1B, FIGS. 2A and 2B show a top cross-sectional view and a side cross-sectional view of the air intake assembly 102 (the latter view being taken along line B-B of the former view) while, similar to FIG. 1C, FIG. 2C shows a front perspective view of the intake manifold 106 (again with the view of FIG. 2A being consistent with a cross-section taken along line A-A of FIG. 2C). In this embodiment, the carburetor 104 can be identical to the carburetor 4. However, the intake manifold 106 differs somewhat from the intake manifold 6 of FIGS. 1A-1C in that first and second intake tubes 124 and 126 of the intake manifold 106 extend not merely outward away from one another but also downward from a communication port 108 of the intake manifold. Consequently, the intake tubes 124 and 126 respectively include downwardly-curving elbows 132 and 134, respectively, as visible particularly in FIG. 2A. Further, the intake manifold 106 also differs from the intake manifold 6 in that the intake tubes 124, 126 have outlet ends 130 that are substantially perpendicular in direction relative to the inlet ends 128, as visible particularly in FIG. 2C.

Nevertheless, otherwise the air intake assembly 102 is substantially the same as the air intake assembly 2. In particular, components 110, 112, 114, 115, 116, 118, 120, 122, 124, 126, 128, 130, 136, 138, 140, 142, 144, 146, 148, 150 and 152 of the air intake assembly 102 (aside from the above-mentioned differences regarding the intake tubes, etc.) are similar in configuration and operate in the same manner, respectively, as the respective components 10, 12, 14, 15, 16, 18, 20, 22, 24, 26, 28, 30, 36, 38, 40, 42, 44, 46, 48, 50 and 52 of the air intake assembly 2 described above. In particular, the communication port 108, a support flange 136, a communication channel 146 and a wall 150 of the intake manifold 106 operate in essentially the same manner as do the corresponding components 8, 36, 46 and 50 described above in terms of allowing the cross-migration of charge between the intake tubes 124, 126 while at the same time restricting the cross-migration of wet fuel, so as to allow enhanced engine power without increased emissions.

Figure 3A:
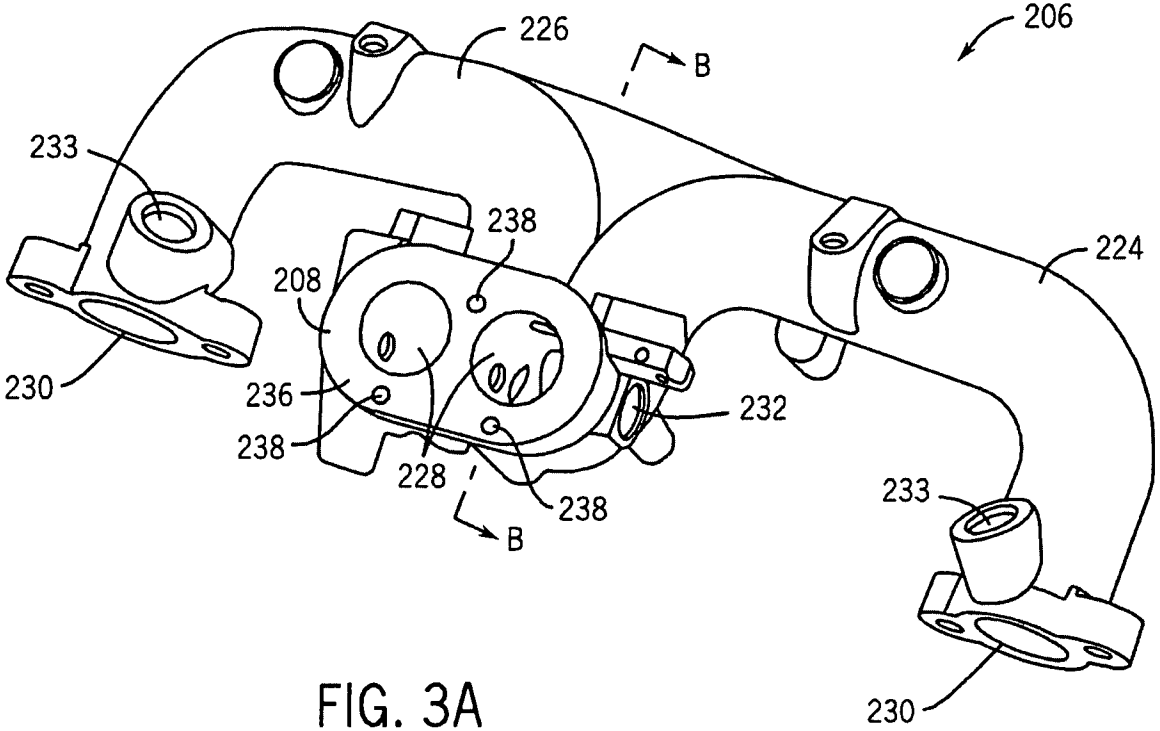
FIG. 3A is a front perspective view of an exemplary fuel injection manifold in accordance with a further embodiment of the present invention.
Figure 3B:
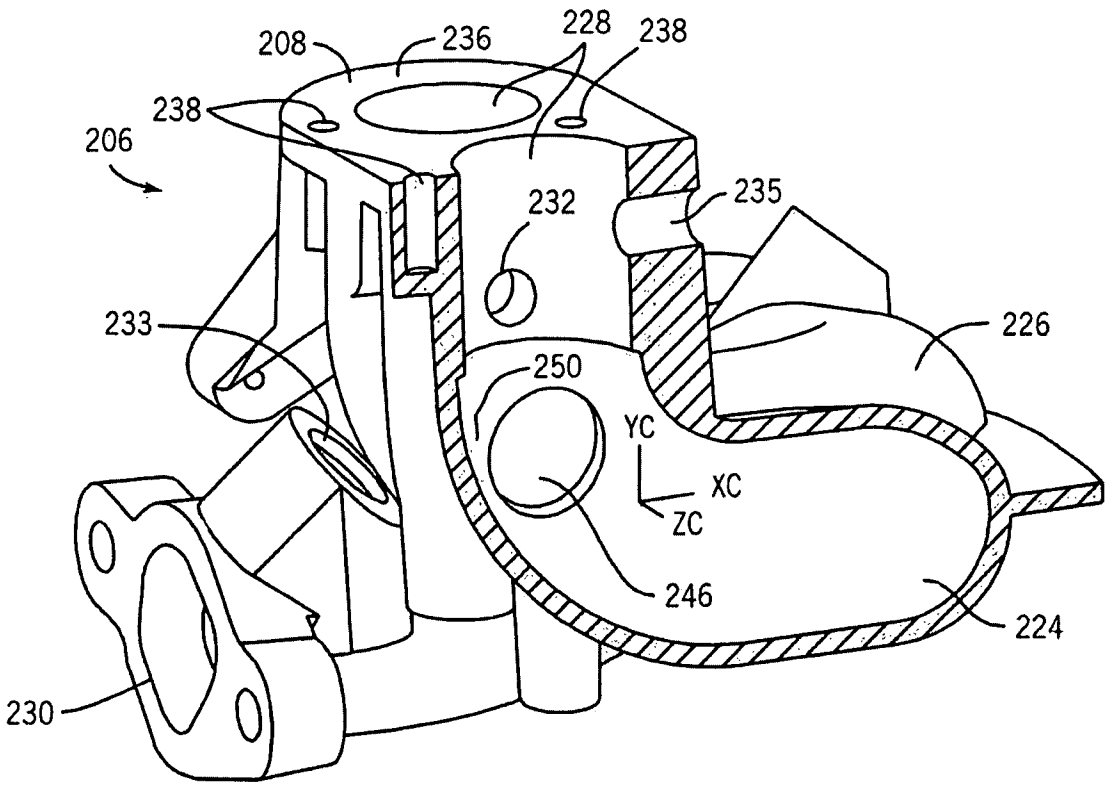
FIG. 3B is a side perspective cross-sectional view of the fuel injection manifold of FIG. 3A, where the cross-section is taken along line B-B of FIG. 3A.

Turning to FIGS. 3A-3B, an additional exemplary manifold 206 in accordance with a further embodiment of the present invention is shown. FIG. 3A in particular provides a front perspective view of the manifold 206, while FIG. 3B shows a perspective, cross-sectional view of the manifold taken along line B-B of FIG. 3A. In contrast to the embodiments of FIGS. 1A-2C, the manifold 206 is a fuel injection manifold configured for operation as part of an engine employing fuel injectors rather than a carburetor. More particularly as shown, the fuel injection manifold 206 has first and second cylindrical intake tubes 224 and 226 that extend from two inlet ends 228 at a communication port 208 to two outlet ends 230. The communication port 208 is formed within a support flange 236, to which can be coupled another structure such as an air cleaner assembly by way of bolts (or other fastening devices), which in the present embodiment can be fixed within three bolt holes 238 of the support flange. As shown in FIG. 3A, the intake tubes 224, 226 as viewed looking inward into the communication port 208 extend rearward, then bend upwards, then bend sideways (rightward and leftward, respectively), and then bend downward to the respective outlet ends 230 (which in the present embodiment open downward).

As already noted, in contrast to the embodiments of FIGS. 1A-2C, the fuel injection manifold 206 is not intended to be coupled to a carburetor. Further, the manifold 206 is intended to support therewithin, particularly just inwardly of the communication port 208 within the intake tubes 224, 226, a pair of throttles (not shown), which are rotatably supported by way of throttle support holes 232 extending through the manifold. In place of the carburetor, the fuel injection manifold 206 also includes, proximate the outlet ends 230 of the first and second intake tubes 224 and 226, two fuel injector bores 233, each of which is configured to receive a respective fuel injector (not shown) that is capable of injecting fuel into a cylinder coupled to the manifold 206 at its respective outlet end. Also as shown, extending outward and upward from the intake tubes 224, 226 are additional holes 235 (one of which is shown in FIG. 3B), which serve as breather orifices and/or are capable of receiving breather fittings.

Similar to the manifolds of FIGS. 1A-2C, and particularly as shown in FIG. 3B, the fuel injection manifold 206 includes an additional communication channel 246 linking the first and second intake tubes 224 and 226, respectively. As shown, the communication channel 246 in this embodiment is cylindrical with a center axis above the center axes of the intake tubes 224, 226 (as well as above the center axis of the throttle support holes 232). While the communication channel 246 in this embodiment is not entirely positioned above a midline passing through the two intake tubes as was the case in the embodiments of FIGS. 1A-2C, nevertheless the communication channel is positioned predominantly above this midline, such that a wall 250 still separates the intake tubes 224, 226 along their lower regions.

The positioning of the communication channel 246 in this manner is possible insofar as the amount of wet fuel that makes its way back to the communication port 208 from the fuel injectors at the fuel injector bores 233 is somewhat less than the amount of wet fuel that makes its way from the carburetors 4, 104 to the communication ports 8, 108 of the embodiments of FIGS. 1A-2C. Nevertheless, in the present embodiment, it is still often if not always desirable that a wall such as the wall 250 separate the lower portions of the intake tubes 224, 226 beneath the communication channel 246 to limit the movement of wet fuel between the tubes. Also, while in the present embodiment the communication channel 246 is substantially cylindrical (e.g., circular in cross-section), in at least some embodiments, it is also desirable that the communication channels within fuel injection manifolds extend farther along the path of flow than they extend along the widths of the intake tubes that they connect (that is, as discussed above with respect to FIGS. 1A-2C, it can be desirable that such communication channels have depths greater than their widths).

As is evident from the above discussion, each of the air intake assemblies/fuel injection manifold shown in FIGS. 1A-3B can be employed in conjunction with one or more types of internal combustion engines. Referring to FIG. 4, for example, the air intake assembly 2 of FIGS. 1A-1C can be employed in conjunction with the engine 300, which is a horizontal crankshaft engine. Also, for example, the air intake assembly 102 of FIGS. 2A-2C is instead suited for use with a vertical crankshaft engine (not shown). The engines, which can be (as already described) carbureted or non-carbureted (e.g., fuel-injected) engines depending upon the embodiment, can also vary in terms of the number of cylinders within the engines, the power output of the engines, and a variety of other factors. The engines can be used in a wide variety of applications including, for example, automobiles, boats, aircraft, lawnmowers, tractors, snow blowers, and power machinery.

In at least some embodiments, the engines can include the Courage family of vertical and/or horizontal crankshaft engines available from the Kohler Company of Kohler, Wis. Also, in at least some embodiments, the engines can be small off-road engines (SORE engines) including Class 1 and Class 2 small off-road engines such as those implemented in various machinery and vehicles, including, for example, lawn movers, air compressors, and the like. Indeed, in at least some such embodiments, the present invention is intended to be applicable to "non-road engines" as defined in 40 C.F.R. §90.3, which states in pertinent part as follows: "Non-road engine means . . . any internal combustion engine: (i) in or on a piece of equipment that is self-propelled or serves a dual purpose by both propelling itself and performing another function (such as garden tractors, off-highway mobile cranes, and bulldozers); or (ii) in or on a piece of equipment that is intended to be propelled while performing its function (such as lawnmowers and string trimmers); or (iii) that, by itself or in or on a piece of equipment, is portable or transportable, meaning designed to be and capable of being carried or moved from one location to another. Indicia of transportability include, but are not limited to, wheels, skids, carrying handles, dolly, trailer, or platform."

Although the FIGS. 1A-3B described above show certain exemplary embodiments of the present invention, including certain embodiments of intake/fuel injection manifolds and communication channels allowing for intercommunication between the intake tubes of those manifolds, the present invention is intended to encompass a variety of alternative embodiments having one or more features differing from those described above. For example, in at least some alternate embodiments, the shapes, sizes and orientations of the carburetor, fuel injector bores, throttle bores, intake tubes, communication ports, communication channels/bridges, and various other features of the manifolds and related components can vary from those shown. For example, while the walls 50, 150 of the above-described intake manifolds 6, 106 of FIGS. 1A-2C are shown to extend upward about half-way between the respective intake tubes 24, 26 and 124, 126 of those respective manifolds (e.g., from the bottoms of those intake tubes approximately up to the midlines A-A shown in FIGS. 1C and 2C), in alternate embodiments, the extents of those walls, and the extents (widths) of the complementary communication channels 46, 146 adjacent those walls, can vary.

Further, for example, in one alternate embodiment, a communication channel can have a width extending more than (or less than) 50% of the diameter of the intake tubes, such that the corresponding wall will extend less than (or more than) 50% of the diameter of those intake tubes. Also for example, in another alternate embodiment, a communication channel can be configured so that a first portion of the cross-sectional area of the channel above a midline (such as one of the midlines A-A) is greater than a second portion of the cross-sectional area of the channel below the midline. Also, in yet another alternate embodiment a communication channel can be configured so that the channel is entirely located above a location 30% (or 20%, 40% or some other portion) of the distance from the lowermost inner surfaces of the intake tubes to the uppermost inner surfaces of the intake tubes.

Additionally, while the above-described embodiments envision that the communication channels 46, 146 extend from the respective edges of the respective support flanges 36, 136/communication ports 8, 108 inward into the respective intake manifolds 6, 106 (and thus extend all of the way up to the carburetors 4, 104 or gaskets 40, 140), in other embodiments the communication channels can begin somewhat downstream of the junctions between the support flanges/communication ports and the carburetors/gaskets. At the same time, the above-described configurations of FIGS. 1A-2C of communication channels are potentially easier to mold. Likewise the positioning of the communication channel 246 can be moved to different locations within a fuel injection manifold other than that shown in FIGS. 3A-3B. Also, notwithstanding the particular shapes, sizes and arrangements of the communication ports 8, 108, 208, the support flanges 36, 136, 236, the channels 46, 146, 246, and the walls 50, 150, 250, each of the components can vary depending upon the embodiment. For example, the intake tubes 24, 26, 124, 126, 224, 226 need not be cylindrical with round walls but rather can be rectangular with sharp edges and turns. Also, in at least some embodiments, the single channel 46 (or channels 146, 246) can be replaced with multiple discrete channels, for example, several smaller channels spaced along the extent of the depth 45 of the channel 46.

Further, while the above-described embodiments of air intake assemblies 2, 102 envision the use of two-barrel carburetors and two-tube intake manifolds (typically in conjunction with two combustion cylinders), other embodiments of the invention can involve air intake assemblies employing carburetors with more than two (e.g., three, four or more) barrels and intake manifolds having more than two (e.g., three, four or more) intake tubes. For example, in one exemplary alternate embodiment, the carburetor can have four barrels and the intake manifold can have four intake tubes. In such embodiment, all four intake tubes are connected with one another by three (or four) communication channels similar to the channels 46, 146 discussed above or, alternatively, the four intake tubes are grouped into two pairs, where the intake tubes of each pair are coupled by a respective communication channel.

Likewise, other fuel injection manifold configurations having three or more intake tubes other than the manifold 206 can be implemented. Also, in some such alternate embodiments of fuel injection manifolds, the fuel injector bores (and associated fuel injectors) can be positioned upstream of the positions shown in FIGS. 3A-3B, and possibly even at the location of the communication port 208 and/or at the location of the throttles. In still other alternate embodiments of fuel injection manifolds, the throttles and/or fuel injectors are mounted as parts of components that are distinct from (albeit possibly coupled to) the fuel injection manifolds. Indeed, depending upon the embodiment, varying types of carburetors, fuel injectors, throttles, chokes, intake/fuel injection manifolds and cylinder blocks having a wide variety of arrangements can be used.

Additionally, the different portions of the intake manifolds 6, 106 (or fuel injection manifold 206) such as the intake tubes 24, 26, 124, 126, support flanges 36, 136, etc. can be formed integrally as a single piece or, alternatively, the intake manifolds can be formed from separate pieces fastened together by a wide variety of fasteners commonly available, such as those already discussed above. Further, the number of intake tubes within the communication port 8 need not always correspond to the number of barrels within a carburetor, and/or the number of engine cylinders. In some alternate embodiments, for example, a given carburetor barrel can be in direct communication with more than one of the intake tubes of the intake manifold. Further, the intake manifolds/fuel injection manifolds 6, 106, 206 can be made of a wide variety of substantially rigid materials including for example, molded plastic, aluminum and steel. In other embodiments, rigid materials other than those indicated above can be used.

It is specifically intended that the present invention not be limited to the embodiments and illustrations contained herein, but include modified forms of those embodiments including portions of the embodiments and combinations of elements of different embodiments as come within the scope of the following claims.

We claim:

1. A manifold for use in conjunction with an internal combustion engine, the manifold comprising:

an input end capable of being coupled at least indirectly to an air input device;

first and second intake tubes linking the input end to first and second exit ports, respectively; and a first communication channel linking the first and second intake tubes, wherein the communication channel has a first width that is substantially less than a second width of at least one of the first and second intake tubes, and wherein the communication channel links upper portions of the first and second intake tubes, while lower portions of the intake tubes remain separated by a wall, wherein substantially all of the communication channel is positioned above a cross-section passing through the first and second intake tubes midway between uppermost and lowermost internal surfaces of those tubes longitudinally along portions of the lengths of those tubes at which the communication channel is located.

2. The manifold of claim 1, wherein substantially all of the communication channel is positioned above a midline passing through the first and second intake tubes midway between the uppermost and lowermost internal surfaces of those tubes, the midline being within the cross-section.

3. The manifold of claim 2, wherein a first portion of a cross-sectional area of the communication channel positioned above the midline is greater than a second portion of the cross-sectional area of the communication channel.

4. The manifold of claim 1, wherein the communication channel is positioned above a location that is 30% of a distance between the uppermost and lowermost internal surfaces of the intake tubes.

5. The manifold of claim 1, wherein wet fuel arriving in the first intake tube from a corresponding carburetor barrel substantially remains within the first intake tube and does not pass into the second intake tube via the communication channel.

6. The manifold of claim 1, wherein the communication channel has a depth extending substantially perpendicularly to the first width and substantially perpendicularly to a direction along which the communication channel proceeds in connecting the first and second intake tubes, wherein the depth is greater in extent than the first width.

7. The manifold of claim 1, wherein the communication channel is positioned proximate the input end of the manifold.

8. The manifold of claim 7, wherein the communication channel is positioned at the input end of the manifold.

9. The manifold of claim 1, wherein the intake tubes proceeding from the input end to the exit ports are S-shaped, and wherein the communication channel is U-shaped in cross-section.

10. The manifold of claim 1, wherein the manifold is configured for use as part of one of a vertical crankshaft engine and a horizontal crankshaft engine.

11. An air intake assembly comprising the manifold of claim 1, and further comprising a carburetor that is the air input device, the carburetor having first and second barrels capable of generating first and second amounts of charge within the first and second barrels, wherein the carburetor is at least indirectly coupled to the input end of the manifold, and wherein the first and second amounts of charge are delivered to the first and second intake tubes at the input end.

12. The air intake assembly of claim 11, wherein a gasket is positioned between the input end of the manifold and the carburetor.

13. An internal combustion engine comprising the air intake assembly of claim 11, wherein the engine additionally includes first and second cylinders coupled to the first and second exit ports, respectively.

14. The manifold of claim 1, wherein the manifold is a fuel injection manifold including fuel injector bores capable of receiving fuel injectors.

15. The manifold of claim 14, wherein the manifold supports at least two throttle valves therewithin.

16. An internal combustion engine comprising the manifold of claim 14, wherein the fuel injector bores are located proximate at least one of the input end and the exit ports.

17. An air intake assembly comprising:

a multi-barrel carburetor; and an intake manifold coupled at least indirectly to the carburetor downstream of the carburetor, the intake manifold having multiple passages respectively coupled at least indirectly to respective barrels of the multi-barrel carburetor, wherein the intake manifold further includes means for linking at least two of the multiple passages in a manner consistent with allowing charge to pass between the multiple passages but limiting passage of wet fuel between the multiple passages, so that the wet fuel within a respective one of the passages substantially remains within the respective one passage and does not pass into another of the passages via the means for linking, and wherein substantially all of the means for linking is positioned above a cross-section passing through the multiple passages midway between uppermost and lowermost internal surfaces of those passages longitudinally along portions of the lengths of those passages at which the means for linking is located.

18. The air intake assembly of claim 17, wherein the means for linking has a depth and a width, the depth being greater than the width.

19. An internal combustion engine comprising the air intake assembly of claim 17, and further comprising a plurality of cylinders respectively coupled to downstream ends of respective ones of the multiple passages.

20. A manifold for use in conjunction with an internal combustion engine, the manifold comprising:

an input end capable of being coupled at least indirectly to an air input device;

first and second intake tubes linking the input end to first and second exit ports, respectively;

a communication channel linking upper portions of the first and second intake tubes; and a wall extending between lower portions of the first and second intake tubes;

wherein substantially all of the communication channel is positioned above a cross-section extending substantially along respective center axes of both of the intake tubes along respective portions of respective lengths of the respective intake tubes at which the communication channel is located.

21. The manifold of claim 20, wherein the communication channel allows charge to pass between the intake tubes but the wall limits passage of wet fuel between the intake tubes, so that the wet fuel within a respective one of the intake tubes substantially remains within the respective one intake tube and does not pass into another one of the intake tubes via the communication channel.

* * * * *